US010907938B2

(12) United States Patent
Bates et al.

(10) Patent No.: US 10,907,938 B2
(45) Date of Patent: Feb. 2, 2021

(54) INFRARED CAMOUFLAGE TEXTILE

(75) Inventors: Kenn S. Bates, Lakewood, CA (US); Robert L. Peirce, Torrance, CA (US)

(73) Assignee: Raytheon Company, Waltham, MA (US)

( * ) Notice: Subject to any disclaimer, the term of this patent is extended or adjusted under 35 U.S.C. 154(b) by 1134 days.

(21) Appl. No.: 13/587,989

(22) Filed: Aug. 17, 2012

(65) Prior Publication Data

US 2014/0247478 A1 Sep. 4, 2014

(51) Int. Cl.
*F41H 3/02* (2006.01)

(52) U.S. Cl.
CPC ..... *F41H 3/02* (2013.01)

(58) Field of Classification Search
USPC ..... 359/350–361; 2/900
See application file for complete search history.

(56) References Cited

U.S. PATENT DOCUMENTS 3,986,384 A 10/1976 Giorgi
4,240,212 A 12/1980 Marshall et al.
4,387,301 A 6/1983 Wirick et al.
4,422,646 A 12/1983 Rosa
4,480,372 A 11/1984 Wirick et al.
4,832,451 A 5/1989 Trescott
4,929,841 A 5/1990 Chang
5,041,735 A 8/1991 Chang et al.
5,065,032 A 11/1991 Prosser
5,077,101 A 12/1991 Conway et al.
5,281,460 A 1/1994 Cox
5,324,937 A 6/1994 Chen et al.
5,416,332 A 5/1995 Chen et al.
5,599,023 A 2/1997 Loyd
5,691,542 A 11/1997 Bates et al.
6,338,292 B1 * 1/2002 Reynolds et al. ..... 89/36.02
6,806,480 B2 10/2004 Reshef
6,906,842 B2 * 6/2005 Agrawal et al. ..... 359/265
(Continued)

OTHER PUBLICATIONS

"E Ink Drives Electronic Paper Market Forward; New Vizplex Imaging Film Is Brighter and Faster", E Ink Press Release, http:/ www.eink.com/press/releases/pr100.html, 2 pages; May 9, 2007.
(Continued)

*Primary Examiner* — Robert E. Tallman
(74) *Attorney, Agent, or Firm* — Renner, Otto, Boisselle & Sklar, LLP

(57) ABSTRACT

An infrared camouflage textile, including an emissivity layer on one side of the textile and adapted to provide at least two different infrared emissivities in a pattern; a heating layer between the emissivity and insulating layers; and a power source to the heating layer. The emissivity layer may include a display module including pixel elements displaying the pattern, each pixel element including a display segment; a plurality of first charged pigments in the display segment each having a first charge; a plurality of second charged pigments in the display segment each having a charge opposite the first charge; an electrical contact coupled to the display segment to receive signals creating an electric field in the display segment; at least one computer-readable storage medium including code to transmit signals to the display module that create an electric field in a pixel element form the pattern in the emissivity layer.

18 Claims, 11 Drawing Sheets

(56) References Cited

U.S. PATENT DOCUMENTS

| | | | | |
|---|---|---|---|---|
| 6,927,724 | B2 * | 8/2005 | Snaper | 342/3 |
| 7,102,814 | B1 * | 9/2006 | Hughes | F41H 3/00 250/504 R |
| 7,199,344 | B2 * | 4/2007 | Blake | 250/205 |
| 7,457,441 | B2 | 11/2008 | Hartlove | |
| 7,675,672 | B2 | 3/2010 | Cernasov | |
| 7,820,969 | B2 | 10/2010 | Guinn et al. | |
| 7,843,623 | B2 | 11/2010 | Cernasov | |
| 8,368,760 | B1 * | 2/2013 | Bates | F41J 2/02 345/107 |
| 2002/0033792 | A1 | 3/2002 | Inoue | |
| 2007/0181180 | A1 | 8/2007 | Chou et al. | |
| 2010/0052909 | A1 | 3/2010 | Doan et al. | |
| 2010/0165448 | A1 * | 7/2010 | Sprague | G02F 1/167 359/296 |
| 2012/0185109 | A1 * | 7/2012 | Olson | F41H 3/00 700/300 |

OTHER PUBLICATIONS

"E Ink Introduces Next Generation of Custom Segmented Displays Using E Ink Vizplex Imaging Film", E Ink Press Release, http:/www.eink.com/press/releases/pr102.html, 2 pages; May 23, 2007.
"Epson and E Ink Announce Breakthrough Controller IC for Electronic Paper Displays", E Ink Press Release, http:/www.eink.com/press/releases/pr110.html, 3 pages; Apr. 15, 2008.
U.S. Appl. No. 12/580,920, filed Oct. 16, 2009. Notice of Allowance dated Oct. 5, 2012. Not published until patent issues.

* cited by examiner

INFRARED CAMOUFLAGE TEXTILE

BACKGROUND

Technical Field

The present invention relates to camouflage for both equipment, such as vehicles, tanks, and other apparatus, and personnel, such as soldiers or law enforcement agents. More particularly, the present invention relates to camouflage effective in the near-, mid- and far-infrared wavelength ranges against forward looking infrared cameras and other infrared detection devices.

Prior Art

An ongoing problem is the provision of effective camouflage for both equipment and personnel, particularly protection against wavelengths that are not visible to human eyes but which can be detected by modern detection devices such as forward looking infrared (FLIR) cameras and other detection devices, such as a non-imaging sensor, that utilize wavelengths in the infrared range, i.e., in the near-, mid- and far-infrared wavelength ranges. As is generally known in the art, near-infrared wavelengths are in the range from about 1.5 to about 2.5 microns, mid-infrared wavelengths are in the range from about 3 to about 5 microns, and far-infrared wavelengths are in the range from about 8 to about 12 or 14 microns. As is known in the art, the wavelengths between these ranges, e.g., from about 5.5 to about 7.5 microns, are of little interest because the ambient atmosphere absorbs infrared radiation in these wavelength ranges.

Known infrared camouflage systems rely upon either some combination of strips of material of various emissivities or some combination of generated infrared signature that attempts to disrupt or "over-write" the normal infrared signature of the underlying equipment or personnel. These prior art camouflage systems cannot replace the normal infrared signature of the underlying equipment or personnel, but instead attempt to obscure or obfuscate that normal signature.

Military vehicles and soldiers need a way to camouflage their appearance in the Infrared (IR) from their enemies. This is also true for Homeland Security and DEA as terrorists and drug trafficking organizations also have access to hi-tech equipment.

Accordingly, there is a continuing need for improved infrared camouflage textiles, devices and systems.

SUMMARY

Accordingly, in one embodiment, the present invention relates to an infrared camouflage textile, including an emissivity layer disposed on a side of the textile and adapted to provide at least two different infrared emissivities in a predetermined pattern; a heating layer disposed below the emissivity layer and above the insulating layer; and a power source operably linked to the heating layer.

In one embodiment, the infrared camouflage textile further includes an insulating layer disposed on a first side of a textile and adapted to absorb a native infrared signature of a body adjacent the first side;

In one embodiment, the infrared camouflage textile further includes a thermal conductive or thermal foil layer disposed between the heating layer and the emissivity layer.

In one embodiment, the at least two different infrared emissivities create an infrared signature distinct from the native infrared signature.

In one embodiment, the at least two different infrared emissivities are disposed on a same layer and/or are at the same temperature.

In one embodiment, the predetermined pattern is composed of pixels or subpixels.

In one embodiment, the size of the pixels or subpixels are based on predetermined estimated resolution of and predetermined estimated distance from a FLIR device or a thermal imaging device against which the textile is to provide camouflage.

In one embodiment, the infrared camouflage textile further includes a spacer or stand-off layer between the heating layer and the insulating layer.

In one embodiment, the emissivity layer comprises at least two materials having different infrared emissivities.

In another embodiment, the present invention relates to an infrared camouflage textile, including an emissivity layer disposed on a side of the textile and adapted to provide at least two different infrared emissivities in a selectably pixelated pattern; a heating layer disposed below the emissivity layer and above the insulating layer; and a power source operably linked to the heating layer, in which the emissivity layer includes:

a display module comprising a plurality of pixel elements operable to display the selectably pixelated pattern in the emissivity layer, wherein each pixel element comprises:

a display segment;

a plurality of first charged pigments housed within the display segment each having a first charge;

a plurality of second charged pigments housed within the display segment each having a second charge, wherein the first charge is opposite the second charge;

an electrical contact coupled to the display segment and operable to receive signals that cause an electric field to be present in the display segment;

at least one computer-readable tangible storage medium comprising executable code that, when executed by at least one processor, is operable to transmit signals to the display module that cause an electric field to be present in at least one pixel element of the plurality of pixel elements to form the selectably pixelated pattern in the emissivity layer.

In one embodiment, the infrared camouflage textile further includes an insulating layer disposed on a first side of a textile and adapted to absorb a native infrared signature of a body adjacent the first side;

In one embodiment, the infrared camouflage textile further includes a thermal conductive or thermal foil layer disposed between the heating layer and the emissivity layer.

In one embodiment, the at least two different infrared emissivities create an infrared signature distinct from the native infrared signature.

In one embodiment, the selectably pixelated pattern comprises subpixels.

In one embodiment, the size of the subpixels is based on a predetermined estimated resolution of and a predetermined estimated distance from an infrared camera or non-imaging thermal sensing device against which the textile is to provide camouflage.

In one embodiment, the infrared camouflage textile further includes a spacer or stand-off layer.

In one embodiment, the emissivity layer comprises at least two materials having different infrared emissivities.

In one embodiment, the selectably pixelated pattern is based on output of an infrared camera or non-imaging thermal sensing device.

In one embodiment, the infrared camouflage textile further includes a plurality of outwardly facing surfaces each displaying a portion of the selectably pixelated pattern, and the selectably pixilated pattern of each outwardly facing surface is selected based on output of an infrared camera or non-imaging thermal sensing device associated with that outwardly facing surface.

BRIEF DESCRIPTION OF THE DRAWINGS

The foregoing and other features and advantages of the present invention will become apparent upon consideration of the specification and appended drawings, in which.

Figure 1:
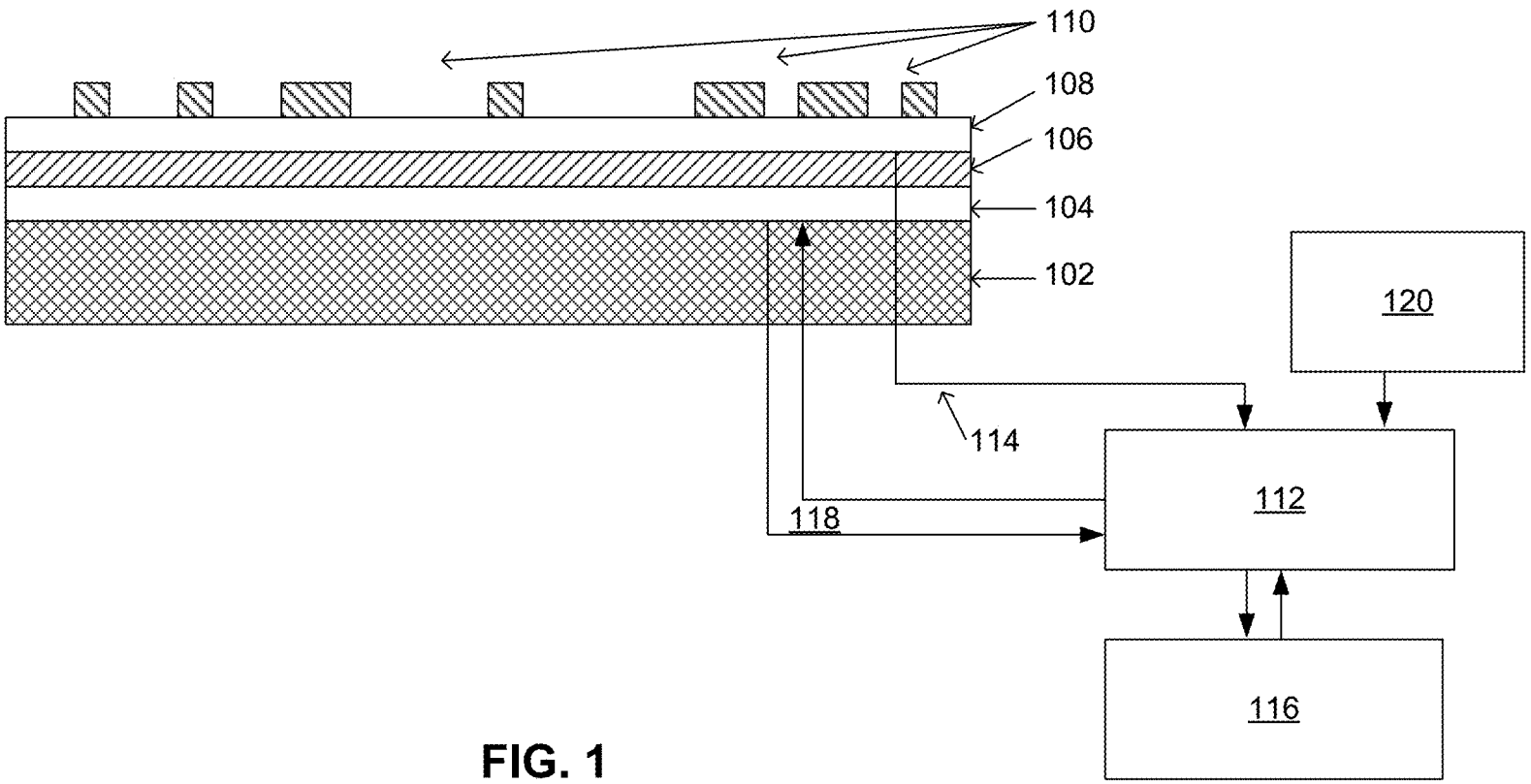
FIG. 1 is a schematic diagram depicting one embodiment of an infrared camouflage textile in accordance with the present invention.

It should be appreciated that for simplicity and clarity of illustration, elements shown in the Figures have not necessarily been drawn to scale. For example, the dimensions of some of the elements may be exaggerated relative to each other for clarity. Further, where considered appropriate, reference numerals have been repeated among the Figures to indicate corresponding or same elements.

Furthermore, it should be appreciated that the process steps and structures described below may not form a complete process flow for producing an infrared camouflage textile or system. The present invention can be practiced in conjunction with known materials and manufacturing techniques currently used in the art, and only so much of the commonly practiced process steps are included as are necessary for an understanding of the present invention.

DETAILED DESCRIPTION

The present invention provides, inter alia, an infrared camouflage textile in which a new camouflage infrared (IR) pattern may be substituted for a vehicle's or a soldier's native IR signature. The infrared camouflage textile does two things: 1) it blocks most of the original IR signature of the protected target, 2) it creates a new IR camouflage pattern signature by providing differing "emissivities" on the surface, which pattern is presented in a sub-pixel pattern, and thereby creates multiple "effective" temperatures even though the blanket actually stays at one temperature.

The infrared camouflage textile does not need to be custom installed on the vehicle, as in the known systems. The infrared camouflage textile of the present invention is like an IR "car cover".

The infrared camouflage textile is significantly lighter than the known camouflage systems. It is scalable to be utilized by the individual soldier whereas known systems, e.g., systems which utilize large heavy copper plates, are not. The infrared camouflage textile may be incorporated into an individual soldier's uniform and as such would be significantly more effective than current Desert Night Camouflage uniforms in the midwave and Far Infrared (IR) where the newer night vision detection systems function.

The infrared camouflage textile in accordance with the present invention utilizes sub-pixel technology to create multiple-temperatures on a large scale while maintaining a constant temperature. The infrared camouflage textile provides external heating to maintain an external temperature but provides effectively different temperatures by presenting a second emissivity pattern as sub-pixels thereby providing a continuum of differing apparent temperatures.

FIG. 1 is a schematic diagram depicting one embodiment of an infrared camouflage textile 100 in accordance with the present invention present invention. As shown in FIG. 1, in one embodiment, the textile 100 includes an insulation layer 102, a heating layer 104 overlaying the insulation layer 102, a thermal foil layer 106 overlaying the heating layer 104, an emissivity substrate layer 108 overlying the thermal foil layer 106, and an emissivity pattern 110 disposed on the emissivity substrate layer 108. The emissivity substrate 108 has a first emissivity and the emissivity pattern 110 has a second emissivity. Although not shown in FIG. 1, the textile 100 may include a plurality of emissivity patterns on the emissivity substrate 108. The emissivity substrate 108 and the one or more emissivity pattern 110 together define an emissivity layer, and result in the formation of two distinct emissivities displayed by the emissivity layer.

As shown in FIG. 1, the infrared camouflage textile 100 further includes a temperature controller 112 and a temperature probe 114. The temperature controller 112 may be any suitable temperature control device, such as an analog thermostat, a digital programmable thermostat, a computer-based temperature controller or a component of a computer system such as that described below with respect to FIG. 10. In one embodiment, the temperature controller 112 operably communicates with a device for controlling an active emissivity layer, e.g., an IR e-ink laminate as described below with respect to FIGS. 4-6. In one embodiment, both the temperature controller 112 and the device for controlling an active emissivity layer are components of or are in operable communication with a computer system such as that described below with respect to FIG. 10.

The temperature probe 114 communicates with the heating layer 104 and/or the thermal foil layer 106 and/or the insulation layer 102 and/or the emissivity layer (as defined above) to determine the temperature(s) of each of one or more of these layers and to provide this data to the temperature controller 112. As will be understood, the temperature probe 114 may detect separately the temperatures of each of the layers, or may detect an overall composite temperature, depending on the configuration of the temperature probe 114, and on the information needed by the temperature controller 112, as will be understood.

The temperature controller 112 is powered by a battery pack 116 in the embodiment of FIG. 1. In alternate embodiments, the battery pack 116 may be a power source such as any known conventional power source, for example, a vehicle with which the infrared camouflage textile 100 is being used, a conventional alternating current source, or a solar- or wind-based power source.

The temperature controller 112 is connected to and/or includes an ambient sensor 120. In one embodiment, the temperature The ambient sensor 120 senses and provides information relating to the ambient environment, including, for example, information about the ambient temperature, ambient weather conditions including relative humidity, wind speed and direction, the infrared signature of the ambient surroundings, or any other ambient condition that may have relevance to the operation of the infrared camouflage textile 100.

The temperature controller 112 is operably connected to the heating layer 104 via linkages 118. The linkages 118 are most often electrical wires transmitting electrical energy to the heating layer 104, by which the heating layer 104 is powered to create heat. In other embodiments, the linkages 118 may include other sources of power to provide heat to the heating layer 104, such as microwave energy, heated liquids, or other known sources of energy by which the heating layer 104 can be heated. The heating layer 104 may include a heating element such as a rubber pad or Kapton heater containing resistive elements, or may be implemented using a heating blanket or oven. The thermal foil layer 106 may be utilized to assist in selectively and/or uniformly distributing heat generated by the heating layer 104, to provide heat for the emissivity substrate 108 emissions. As explained in more detail below, in accordance with some embodiments of the present invention, the emissivity of the emissivity substrate 108 is selectively and controllably altered by the emissivity pattern 110.

Figure 2:
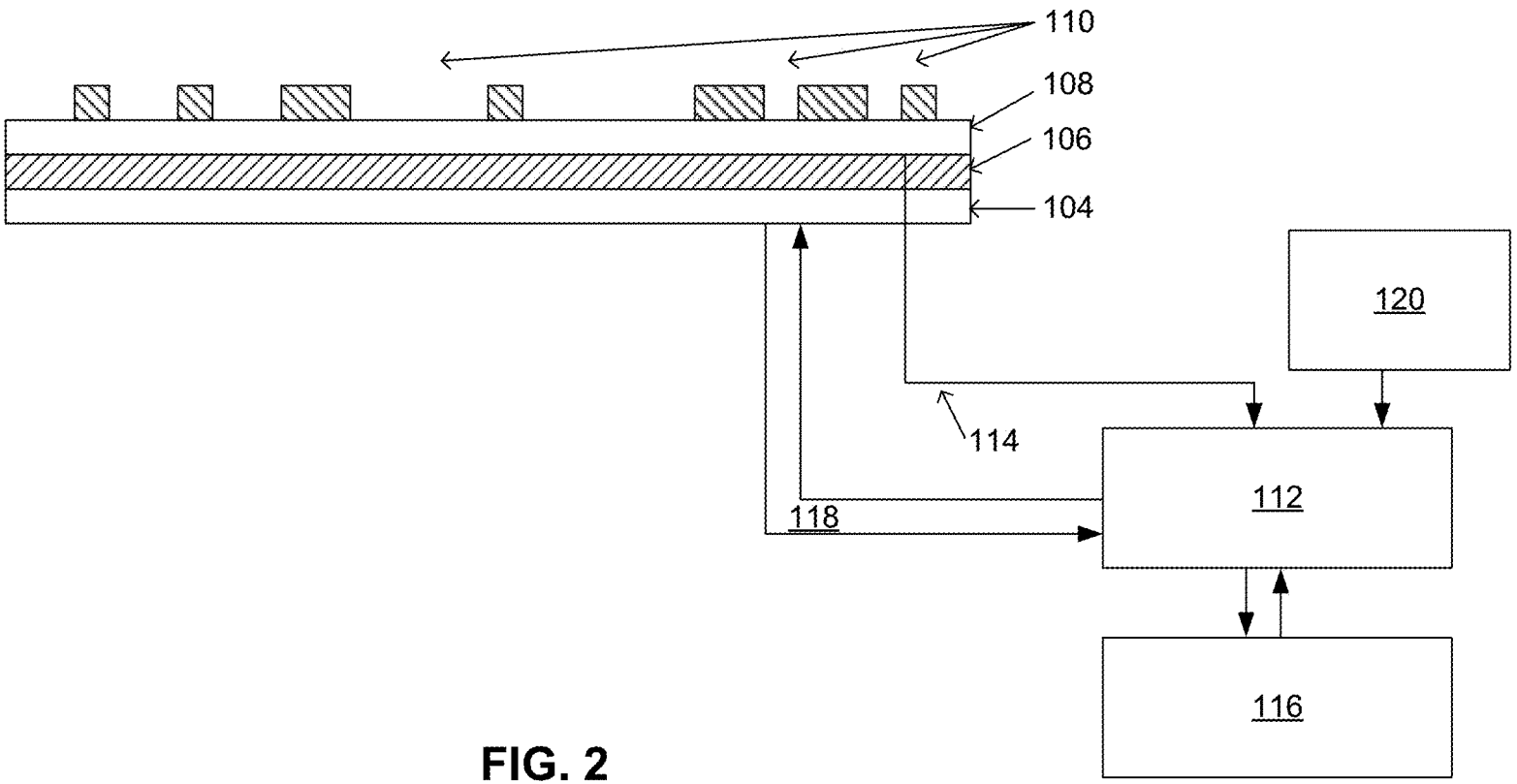
FIG. 2 is a schematic diagram depicting another embodiment of an infrared camouflage textile in accordance with the present invention without an insulation layer.

FIG. 2 is a schematic diagram depicting another embodiment of an infrared camouflage textile 200 in accordance with the present invention. The textile 200 is substantially the same as the textile 100 depicted in FIG. 1 and described above, except that it does not include an insulation layer.

In operation, the textile 200 functions substantially the same as described above for the embodiment depicted in FIG. 1, except that, since the insulation layer is not present, there is no shielding effect provided for the temperature, emissivity and/or infrared signature of the body (such as an individual soldier, a weapon, a vehicle, etc.) that would be on the to-be-camouflaged side of the textile 200. This embodiment would be used, for example, as a blanket or a component of clothing of an individual soldier, weapon, or other object when the infrared signature of the soldier, weapon or other object does not have a significant infrared signature of its own or when the soldier, weapon or other object has an infrared signature or emissivity that does not differ substantially from the emissivity of the local environment or has an infrared signature or emissivity that is adequately combined with or shielded by the textile 200. Thus, for example, when a person is in an environment that has a temperature similar to that of the human body, the insulation layer may be dispensed with.

In one embodiment, the textile may be configured such that an insulation layer can be included or removed as needed. That is, the insulation layer 102 of FIG. 1 may be removable, which would yield a textile substantially the same as or similar to the textile 200 depicted in FIG. 2.

Figure 3:
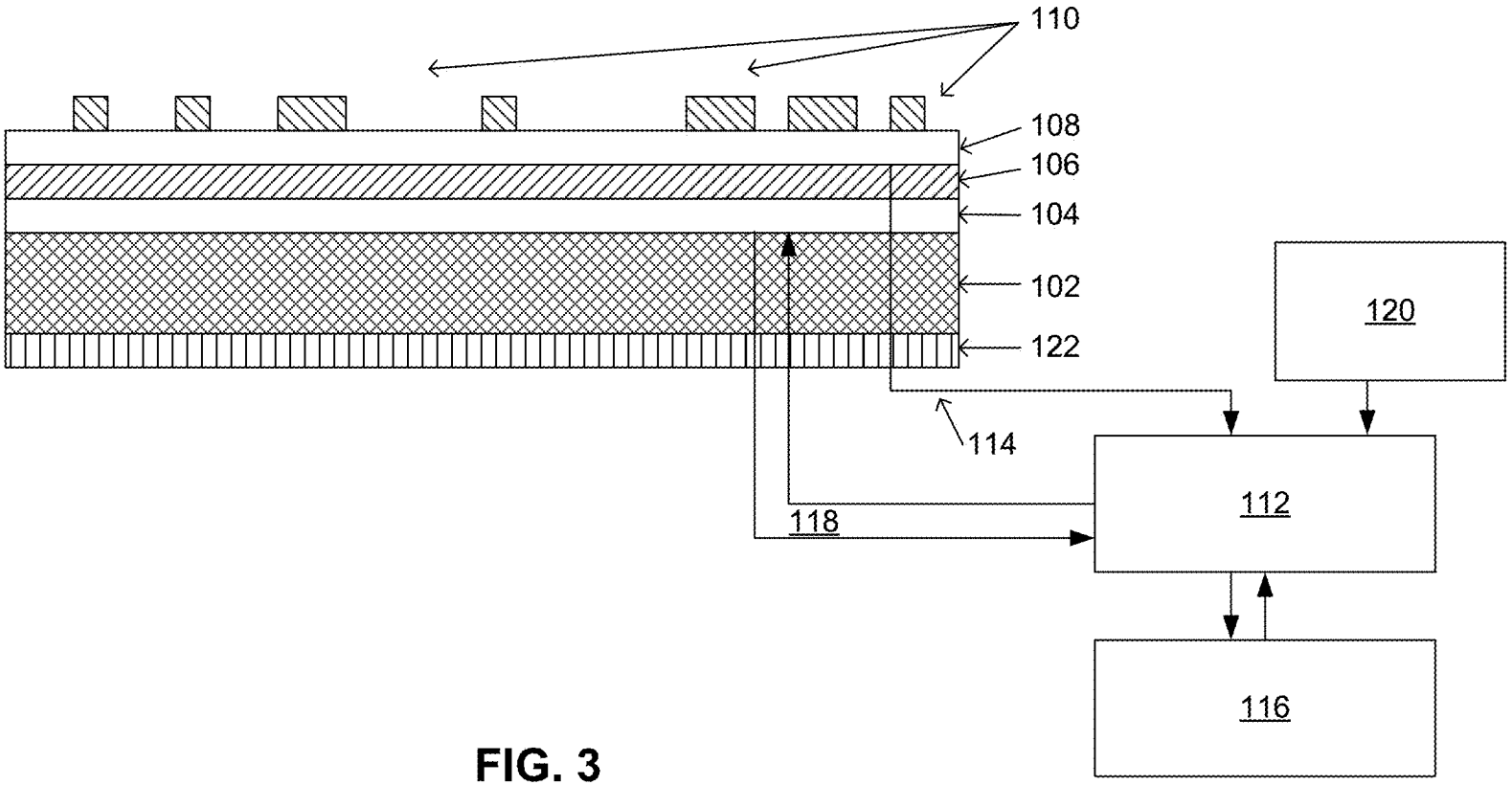
FIG. 3 is a schematic diagram depicting another embodiment of an infrared camouflage textile in accordance with the present invention.

FIG. 3 is a schematic diagram depicting another embodiment of an infrared camouflage textile 300 in accordance with the present invention, similar to the embodiment of FIG. 1, further including a layer 122. The textile 300 is substantially the same as the textiles 100, 200 depicted in FIGS. 1 and 2, respectively, and described above, except that it includes the standoff layer 122, positioned between the insulation layer 102 and user or object to be camouflaged, on the outside of the insulation layer 102, as shown in FIG. 3. In one embodiment, not shown, a standoff layer may be positioned elsewhere, such as between the insulation layer 102 and the heating layer 104. Similarly, a standoff layer may be added to the embodiment of FIG. 2, in the position of the insulation layer in FIG. 1.

The standoff layer 122 provides separation between the insulation layer 102 and the user or the object to be camouflaged, as a result of which, the user or object to be camouflaged is separated from the remainder of the textile 300. If the standoff layer 122 is positioned elsewhere, such as between the insulation layer 102 and the heating layer 104, the standoff layer 122 may also allow more efficient use of the heating layer 104, since it would not be in direct contact with the insulation layer 102 and so would not lose as much heat to the insulation layer. In an embodiment lacking an insulation layer, if a standoff layer is used in the position adjacent the heating layer 104, i.e., the position shown in FIG. 1 for the insulation layer, separation of the heating layer from the person or object to be camouflaged would avoid heating the person or object.

In operation, the embodiments of the infrared camouflage textile 100, 200, 300 of FIGS. 1-3 generally function as follows. Initially, the infrared camouflage textile includes the emissivity substrate layer 108 with the emissivity pattern 110 disposed on the surface of the layer 108 in a predetermined pattern, which is usually a selectively chosen camouflage pattern, but may be other, such as a random pattern, as desired. Initially, the temperature controller 112, which is connected to and/or includes an ambient sensor 120, receives information and/or data from the sensor 120 as to ambient conditions. The temperature probe 114 provides information and/or data to the temperature controller as to the temperature of the thermal foil layer 106 and adjacent layers of the infrared camouflage textile. Based on the sensed temperatures and infrared signature of the ambient environment, on the sensed temperature of the thermal foil layer 106 and adjacent layers, and on the known emissivities of the emissivity substrate layer 108 and the emissivity pattern 110, the temperature controller 112 transmits power to the heating layer 104 via the electrical connection 118. As described above, the emissivity pattern 110 can be provided in a sub-pixel pattern, in which each sub-pixel is far below the pixel size of the expected detection device from which the infrared camouflage textile is intended to provide protection. As a result of the heat provided by the heating layer 104, the emissivities of the emissivity substrate layer 108 and the emissivity pattern 110 can be adjusted and combined to provide a pattern of infrared signature that serves to camouflage whatever vehicle, person or other item is behind the infrared camouflage textile 100, 200, 300 and is desired to be protected from detection.

Figure 4:
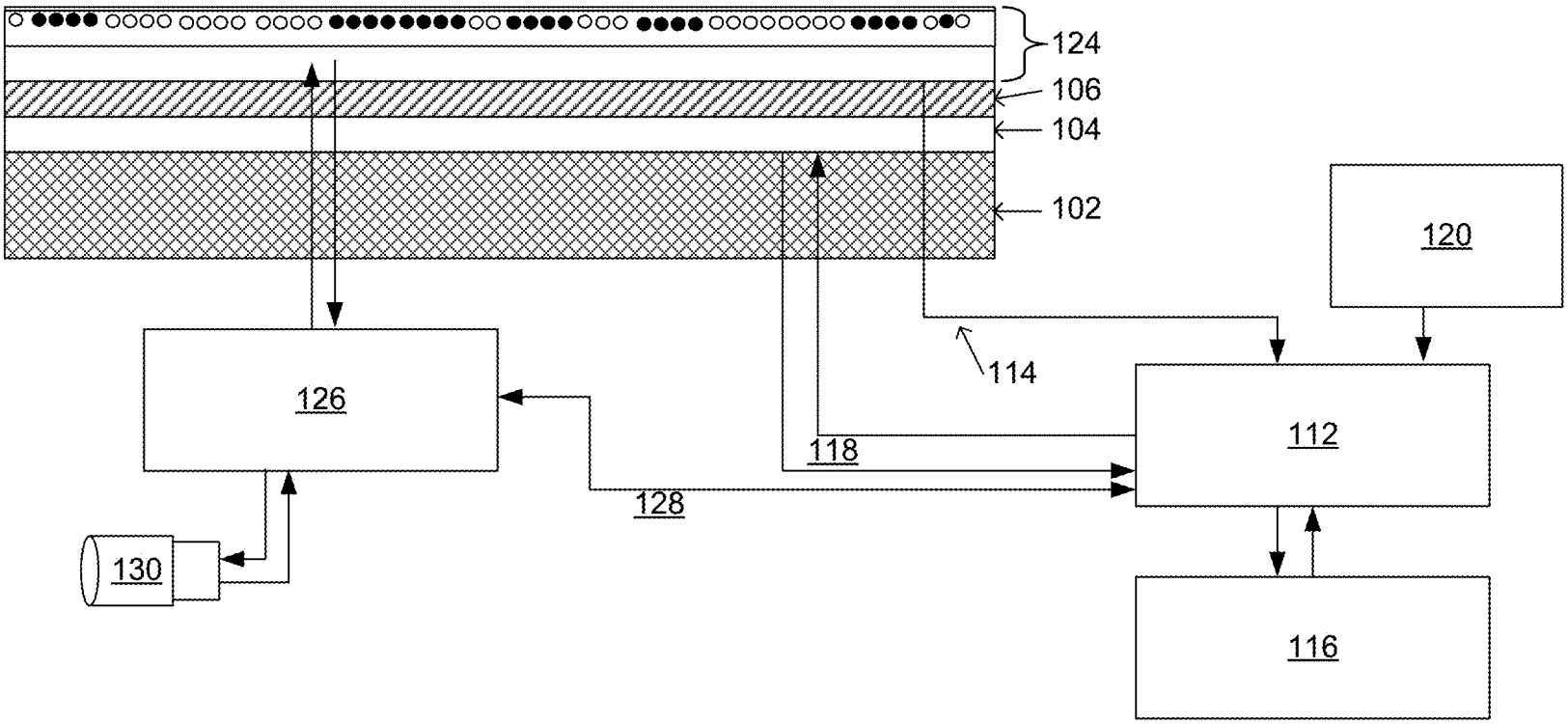
FIG. 4 is a schematic diagram depicting another embodiment of a dynamic infrared camouflage textile in accordance with the present invention with an insulation layer.

FIG. 4 is a schematic diagram depicting another embodiment of an infrared camouflage textile 400 in accordance with the present invention. Some of the components of the embodiment of FIG. 4 are similar to or the same as corresponding components in the embodiment of FIG. 1, but are reviewed again for completeness. As shown in FIG. 4, in one embodiment, the textile 400 includes an insulation layer 102, a heating layer 104 overlaying the insulation layer 102, a thermal foil layer 106 overlaying the heating layer 104, an IR e-ink laminate 124, discussed in greater detail below.

As shown in FIG. 4, the infrared camouflage textile 400 further includes a temperature controller 112 and a temperature probe 114. The temperature controller 112 may be any suitable temperature control device, such as an analog thermostat, a digital programmable thermostat, a computer-based temperature controller or a component of a computer system such as that described below with respect to FIG. 10. In one embodiment, the temperature controller 112 operably communicates with a device for controlling the IR e-ink laminate 124, which provides for active control of the emissivities as described below. In one embodiment, both the temperature controller 112 and the device for controlling IR e-ink laminate 124 are components of or are in operable communication with a computer system such as that described below with respect to FIG. 10.

The temperature probe 114 communicates with the heating layer 104 and/or the thermal foil layer 106 and/or the insulation layer 102 and/or the IR e-ink laminate 124 to determine the temperature(s) of each of one or more of these layers and to provide this data to the temperature controller 112. As will be understood, the temperature probe 114 may detect separately the temperatures of each of the layers, or may detect an overall composite temperature, depending on the configuration of the temperature probe 114, and on the information needed by the temperature controller 112, as will be understood.

The temperature controller 112 is powered by a battery pack 116 in the embodiment of FIG. 4. In alternate embodiments, the battery pack 116 may be a power source such as any known conventional power source, for example, a vehicle with which the infrared camouflage textile 100 is being used, a conventional alternating current source, or a solar- or wind-based power source.

The temperature controller 112 is connected to and/or includes an ambient sensor 120. In one embodiment, the ambient temperature sensor 120 senses and provides information relating to the ambient environment, including, for example, information about the ambient temperature, ambient weather conditions including relative humidity, wind speed and direction, the infrared signature of the ambient surroundings, or any other ambient condition that may have relevance to the operation of the infrared camouflage textile 100.

Still referring to FIG. 4, the temperature controller 112 is operably connected to the heating layer 104 via linkages 118. The linkages 118 are most often electrical wires transmitting electrical energy to the heating layer 104, by which the heating layer 104 is powered to create heat. In other embodiments, the linkages 118 may include other sources of power to provide heat to the heating layer 104, such as microwave energy, heated liquids, or other known sources of energy by which the heating layer 104 can be heated. The heating layer 104 may include a heating element such as a rubber pad or Kapton heater containing resistive elements, or may be implemented using a heating blanket or oven. The thermal foil layer 106 may be utilized to assist in selectively and/or uniformly distributing heat generated by the heating layer 104, to provide heat to the IR e-ink laminate 124, thereby providing additional emissivity to the IR e-ink laminate 124. As explained in more detail below, in accordance with some embodiments of the present invention, the emissivity of the IR e-ink laminate 124 is selectively and controllably altered by a programmable pattern CPU 126, which may be a component of the computer system described below.

As shown in FIG. 4, the programmable pattern CPU 126 is linked to the temperature controller 112 via a power and communication connection 128. The connection 128 provides both power, from the battery pack 116, and communications regarding the temperatures of the heating layer 104 detected via the temperature probe 114 and controlled via the linkages 118, to the programmable pattern CPU 126. In one embodiment, not shown, the temperature controller 112 and the programmable pattern CPU 126 are combined into a single computer system, such as that described below with respect to FIG. 10.

Figure 7:
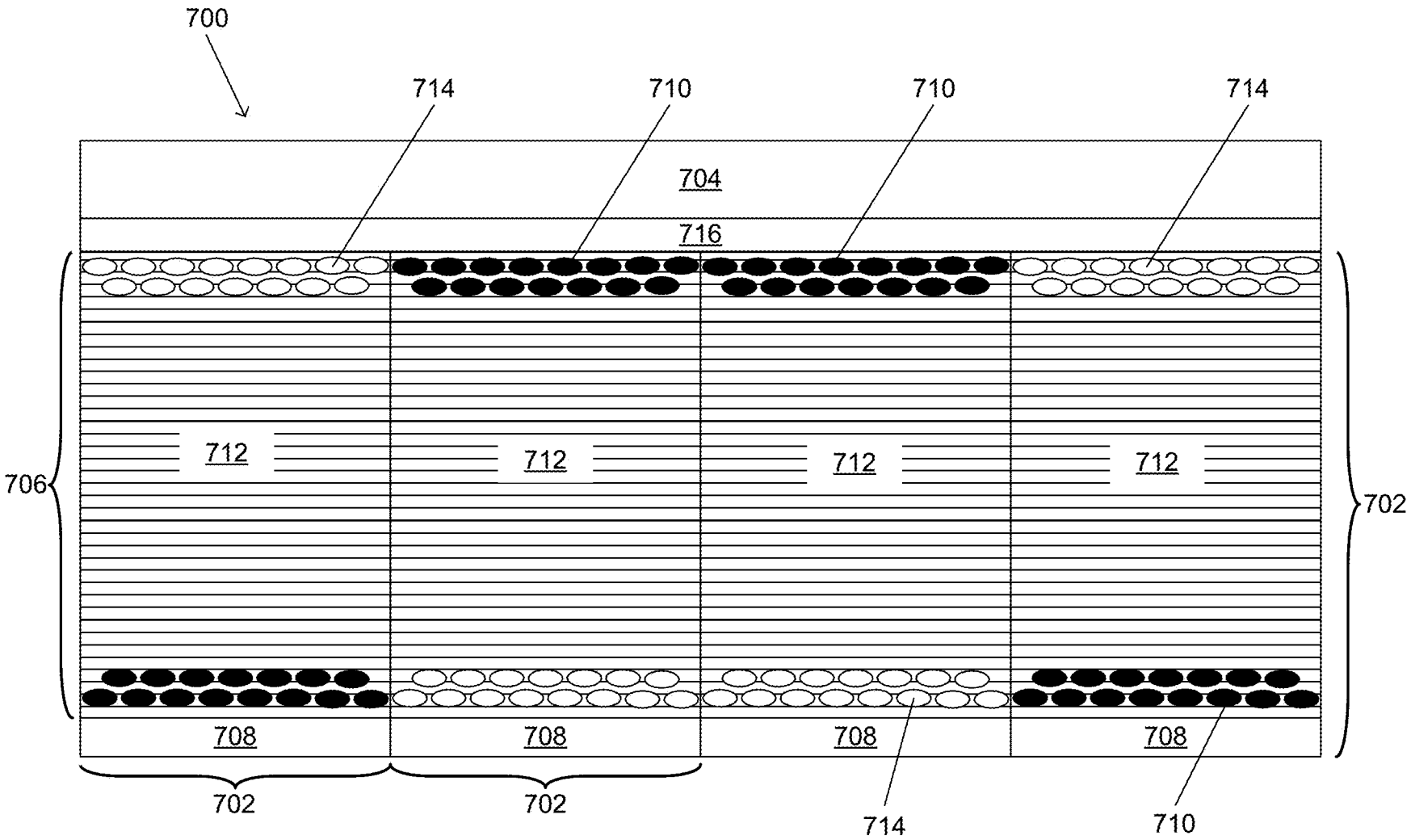
FIG. 7 is a schematic diagram depicting in more detail the IR e-Ink Laminate 124 disclosed above with respect to the embodiments of FIGS. 4-6.

The programmable pattern CPU 126 is used to control the emissivity pattern of the IR e-ink laminate 124, as is described in more detail with respect to FIG. 7.

Referring still to FIG. 4, the system may further comprise one or more IR camera or non-imaging sensor 130. The IR 130 camera or non-imaging sensor may be used to view the immediate surroundings of the infrared camouflage textile 400 and or the infrared camouflage textile 400 itself, or some combination of these, and may also be used to view the more distant environment in which the infrared camouflage textile 400 is located. Although only a single sensor 130 is shown in FIG. 4, a plurality of such sensors may be used, and as many as six or more may be used, in order to obtain a view or sensory information about the surroundings in which the infrared camouflage textile 400 is deployed. The number six may be preferred, so that one sensor 130 can be oriented in each of the x, y and z three-dimensional coordinate directions, in both the (+) and (−) directions of each of the x, y and z coordinates and provide a scene or information to the opposite or conjugate "side" of the blanket as if it was wrapped around a cube.

Figure 5:
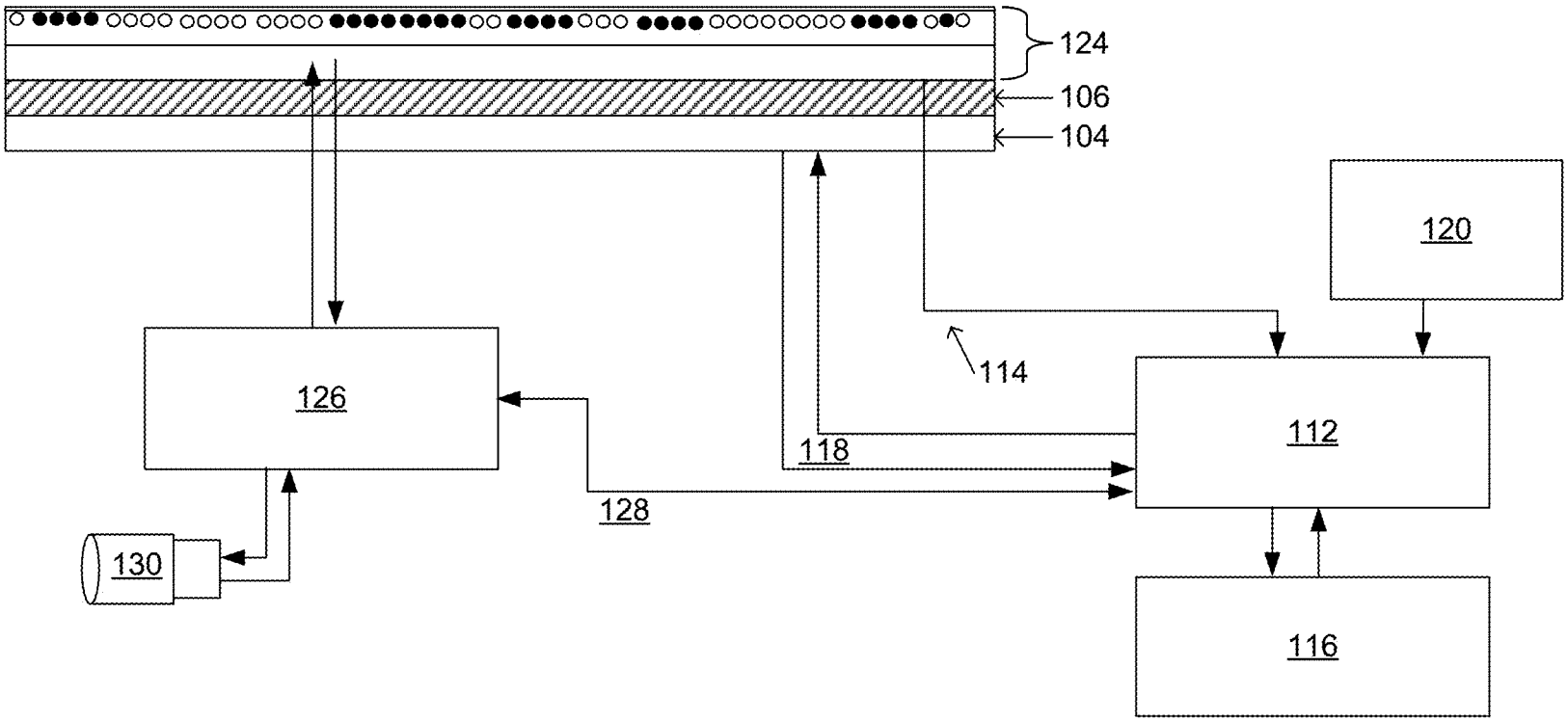
FIG. 5 is a schematic diagram depicting another embodiment of a dynamic infrared camouflage textile in accordance with the present invention without an insulation layer.

FIG. 5 is a schematic diagram depicting another embodiment of an infrared camouflage textile 500 in accordance with the present invention. The textile 500 is substantially the same as the textile 400 depicted in FIG. 4 and described above, except that it does not include an insulation layer. In operation, the textile 500 functions substantially the same as described above for the embodiment depicted in FIG. 4. The effect of the absence of the insulation layer is substantially the same as described above with respect to the embodiment of FIG. 2.

Figure 6:
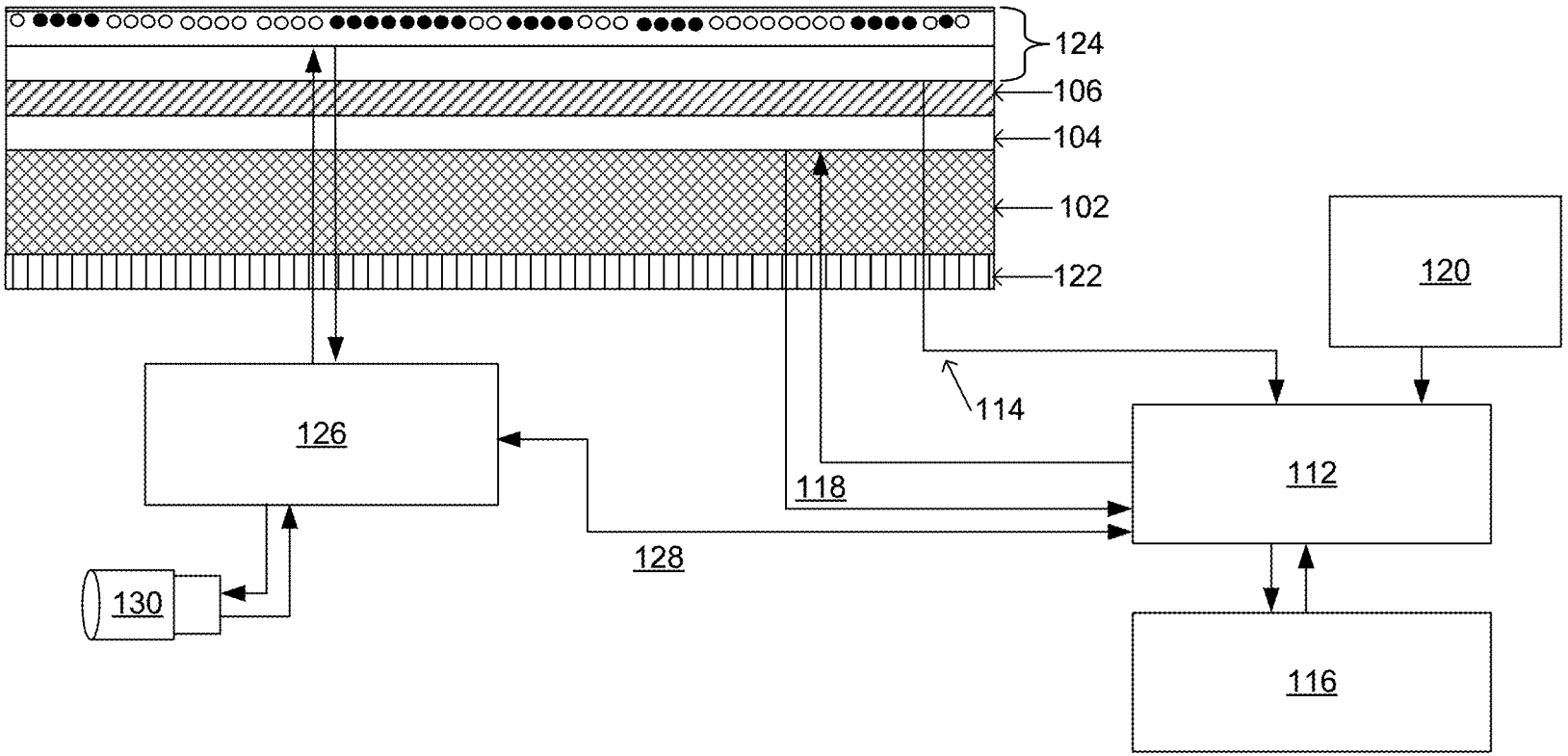
FIG. 6 is a schematic diagram depicting another embodiment of a dynamic infrared camouflage textile in accordance with the present invention including a standoff layer.

FIG. 6 is a schematic diagram depicting another embodiment of an infrared camouflage textile 600 in accordance with the present invention, similar to the embodiment of FIG. 4, further including a standoff layer 122. The textile 600 is substantially the same as the textiles 400, 500 depicted in FIGS. 4 and 5, respectively, and described above, except that it includes the standoff layer 122, positioned between the insulation layer 102 and user or object to be camouflaged, on the outside of the insulation layer 102, as shown in FIG. 6. In one embodiment, not shown, a standoff layer may be positioned elsewhere, such as between the insulation layer 102 and the heating layer 104. Similarly, a standoff layer may be added to the embodiment of FIG. 5, in the position of the insulation layer in FIG. 4.

The standoff layer 122 functions in the textile 600 substantially the same as described above with respect to the embodiment of FIG. 3, with respect to the various positions in which it could be located.

FIG. 7 is a schematic diagram depicting in more detail the IR e-Ink Laminate 124 disclosed above with respect to the embodiments of FIGS. 4-6.

FIG. 7 illustrates one embodiment of a portion of an e-ink laminate, such as the e-ink laminate 124 described with respect to FIGS. 4-6. FIG. 7 illustrates how emissivity patterns may be displayed on an e-ink laminate 700 in various spectrums, such as the visible and IR spectrums. The laminate 700 includes a plurality of pixel elements 702 coupled to a window 704. The pixel elements 702 each include a display segment 706 and electrical contacts 708, respectively. The display segments 706 include first pigments 710, fluids 712, and second pigments 714, respectively. The electrical contacts 708 may be configured to change the electrical fields in fluids 712 using electrical signals received from, e.g., the programmable pattern CPU 126 of FIGS. 4-6, or from the single computer system including both the temperature controller 112 and the programmable pattern CPU 126.

Each pixel element 702, in some embodiments, may use similar materials as found in VIZPLEX® imaging film produced by the E-ink Corporation. The pigments 710 and 714 may comprise common paints, Welsbach materials, lampblack, aluminum, silver, and/or gold particles or any other particles that may be charged. In an exemplary operation, the first pigments 710 and second pigments 714 may be oppositely charged as they are suspended in the fluids 712. As a result, in some embodiments, the first pigments 710 and second pigments 714 may be located at different ends of the display segments 706. The pigments 710 and 714 may be configured such that they have different emissivities. For example, the first pigments 710 may have high emissivity while the second pigments 714 may have low emissivity. In some embodiments, the emissivity characteristics of the pigments 710 and 714 may be appreciable in the 8-14 micron and/or the 3-5 micron bandwidths. A variety of solutions or liquids may be used alone or in combination to form the fluids 712. Such solutions and/or liquids should allow for the movement of the pigments 710 and 714 in response to the application of varying electrical fields to the fluids 712. The fluids 712 may include an organic solvent such as alcohol, as is known in the art.

In some embodiments, the electrical contacts 708 may include one or more of: metal leads, pins, ports, serial connectors, parallel connectors, cable interfaces, and/or plugs. The electrical contacts 708 may receive electrical signals in a manner that causes a corresponding electric field to form in display segments 136. In some embodiments, the electrical contacts 708 may include suitable components to be coupled to the programmable pattern CPU 126 of FIGS. 4-6 and/or the temperature controller 112, or a single computer system including both the temperature controller 112 and the programmable pattern CPU 126, described above. For example, such components may include one or more of: cables, network interfaces, Bluetooth interfaces, interfaces that operate using any of the Institute of Electrical and Electronics Engineers (IEEE) 802 specifications, infrared interfaces, radio frequency (RF) interfaces, and wired interfaces. The electrical contacts 708 may also include converters such as digital-to-analog and analog-to-digital converters. For example, such converters may receive a digital signal and produce an analog signal that causes a particular electrical field to be present in display segments 706. In various embodiments, the electrical contacts 708 may also include converters that can form DC signals from AC signals and vice versa.

The electrical circuit to operate the pixel elements 702 is completed by a layer 716 via the pixel elements 702 from electrical contacts 708. The layer 716 may be a transparent conductive material such as indium tin oxide (ITO) or may be a metallic or conductive polymeric mesh material.

In some embodiments, the window 704 may aid thermal transmission and detection of the emissivity of display segments 706. The window 704 may be formed using one or more of zinc sulfide, zinc selenide, and/or germanium. In some embodiments, utilizing the window 704 may provide for infrared patterns to be formed in the 1.5-2.5 micron spectrum and/or the 3-5 micron spectrum and/or the 8-14 micron spectrum. In some embodiments (not shown) the window 704 may be coated with a clear conductive layer (such as Indium Tin Oxide (ITO)) or a fine mesh screen so as to provide a reference voltage layer or grounding layer.

As discussed above, in various embodiments, various signals may be present at the electrical contacts 708 causing various electrical fields in each of the plurality of display segments 706. Since the first and second pigments 710 and 714 are oppositely charged, the electrical fields present in the display segments 706 may cause the pigments 710 and 714 to be displaced. For example, in the depicted embodiment, the display segment on the left edge of the e-ink laminate 700 of FIG. 7 may have an electric field that is different than the display segment just to its right because the electrical signals applied to the respective electrical contacts 708 are different. As a result, the location of the pigments 710 and 714 are different within each of the respective display segments 706. For similar reasons, the location of the pigments 710 and 714 may be different within each of the display segments 706, as controlled by the computer system described herein.

In some embodiments, the electrical signals applied to the electrical contacts 708 may be the same. As a result, in the depicted embodiment of FIG. 7, second pigments 714 may be located in the same portion of the center two display segments. Similarly, in the depicted embodiment, the first pigments 710 may be located in the same portion of these display segments. As will be understood from the foregoing, by selectively applying electrical signals to the electrical contacts 708, the relative positions of the first and second pigments 710 and 714 may be selectively controlled in each of the display segments 708 and pixel elements 702.

In some embodiments, when the display module 700 is viewed, the line of sight passes through the window 704 to the display segments 706. Thus, the pigments (either the first pigments 710 or the second pigments 714) present on the portion of the display segments 706 adjacent to the window 704 may be viewed. This viewing may occur in the visible spectrum, the infrared spectrum, and/or other spectrums or combinations thereof. For example, the first pigments 710 and second pigments 714 may have different thermal emissivity characteristics such that a device may be able to detect which pigment is present at the portion of the display segments 706 adjacent to the window 704. In various embodiments, this allows the e-ink laminate 700 to selectively display emissivity patterns (e.g., in the visible or infrared spectrums).

In operation, the embodiments of the infrared camouflage textile 400, 500, 600 of FIGS. 4-6 and 7 generally function as follows, which is similar to the description provided above with respect to the embodiment of FIGS. 1-3, except that it includes the IR e-ink laminate described above with respect to FIG. 7.

Initially, the infrared camouflage textile includes the emissivity substrate layer 108 with the emissivity pattern 110 disposed on the surface of the layer 108 in a predetermined pattern, which is usually a selectively chosen camouflage pattern but may be other, such as a random pattern, as desired. Initially, the temperature controller 112, which is connected to and/or includes an ambient sensor 120, receives information and/or data from the sensor 120 as to ambient conditions. The temperature probe 114 provides information and/or data to the temperature controller as to the temperature of the thermal foil layer 106 and adjacent layers of the infrared camouflage textile. In addition, the IR camera or non-imaging sensor 130 provides information and/or data on the initial infrared signature of the infrared camouflage textile and whatever infrared signature may be displayed by the underlying object or person to be protected. Based on the sensed temperatures and infrared signatures of the ambient environment, on the sensed temperature of the thermal foil layer 106 and adjacent layers, on the detected infrared signature of the underlying object or person, and on the known initial emissivity of the IR e-ink laminate 124, the temperature controller 112 transmits power to the heating layer 104 via the electrical connection 118. In addition, the programmable pattern CPU 126 controls the emissivity of the IR e-ink laminate 124 to provide a selected and/or programmed sub-pixel pattern of emissivities. As described above, the emissivity of the IR e-ink laminate is provided in a sub-pixel pattern, in which each sub-pixel is far below the pixel size of the expected detection device from which the infrared camouflage textile is intended to provide protection. As a result of the heat provided by the heating layer 104, the emissivity pattern of the IR e-ink laminate 124 can be adjusted and controlled to provide a pattern of infrared signature that serves to camouflage whatever vehicle, person or other item is behind the infrared camouflage textile 400, 500, 600 and is desired to be protected from detection.

Figure 8A:
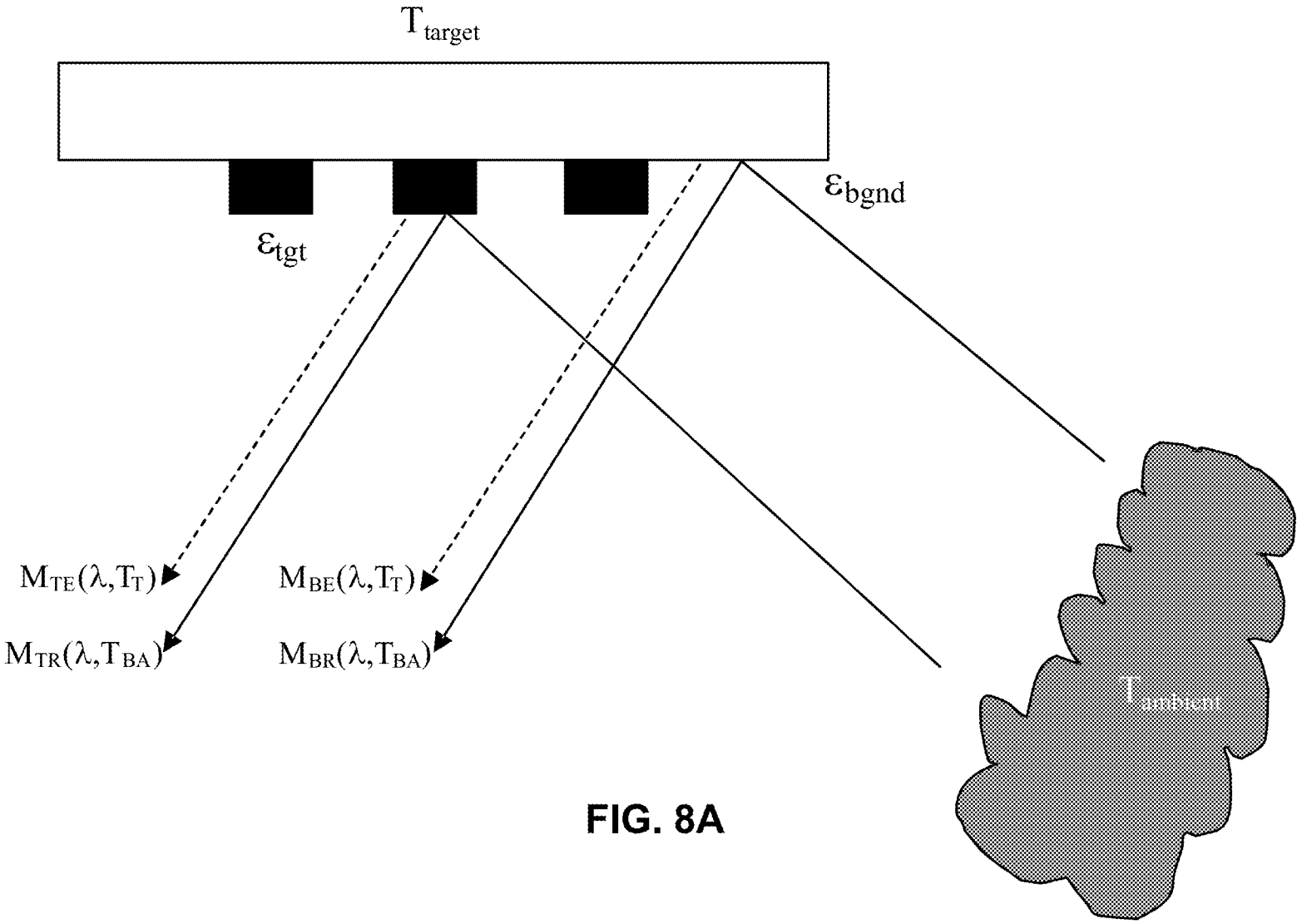
FIGS. 8A and 8B are schematic diagrams showing the application of the Stefan-Boltzmann radiation law to targets having two different emissivities.
Figure 8B:
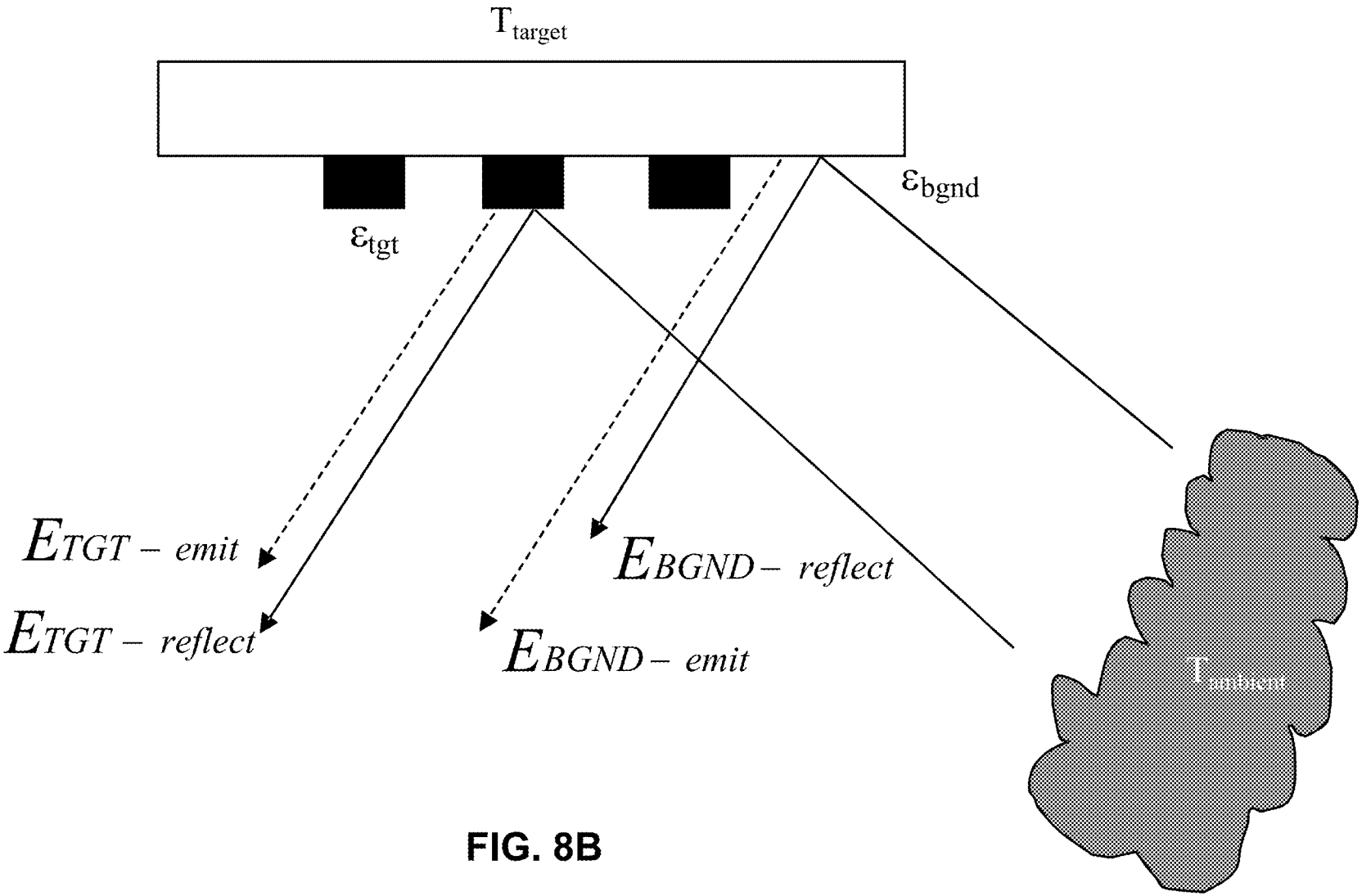

The following discussion, with reference to FIGS. 8A and 8B, provides an explanation of the theoretical background of the present invention. This discussion is provided by way of explanation and the present invention is neither bound nor limited by this discussion. This discussion is presented only to provide an understanding of how the invention is believed to function.

The Stefan-Boltzmann radiation law states that the total energy, E, radiated from a body is defined by:

$$E=\varepsilon\sigma T^4$$

where T is the temperature in degrees Kelvin, ε is emissivity, and a is a constant of proportionality, called the Stefan-Boltzmann constant or Stefan's constant, which derives from other known constants of nature. The value of the constant σ is defined as:

$$\sigma = \frac{2\pi^5 k^4}{15c^2h^3} = 5.670400\times10^{-8}\,Js^{-1}m^{-2}K^{-4}$$

where k is the Boltzmann constant, h is Planck's constant, and c is the speed of light in a vacuum.

FIGS. 8A and 8B are schematic diagrams showing the application of the Stefan-Boltzmann radiation law to targets having two different emissivities, one for the background, designated $\varepsilon_{bgnd}$, and one for a pattern disposed on the background, designated $\varepsilon_{tgt}$.

As shown in FIG. 8A, the background, referred to here as the ambient, is the ambient background environment in which the target is deployed, which has a temperature, $T_{ambient}$, from which radiation at a wavelength λ and a temperature $T_B$ is emitted. This emitted radiation strikes both the target and the pattern and is reflected from the exposed surfaces of the target and the pattern, respectively, partially as ambient energy directly reflected from the surfaces and partially as target energy modified by the emissivity of the surfaces.

As shown in FIG. 8A, the target has a temperature, $T_{target}$. The ambient exitance directly reflected from the target and the pattern is designated $M_{BR}$ (λ, $T_B$) and $M_{TR}$ (λ, $T_B$), respectively. The exitance modified by the emissivity of the target and the pattern is designated $M_{BE}$ (λ, $T_T$) and $M_{TE}$ (λ, $T_T$), respectively. In both exitance expressions, λ is the wavelength of the radiation coming from the target and $T_B$ is the temperature of the ambient reflected from the target, while $T_T$ is the temperature of the of the ambient modified by the emissivity of the target.

Based on the foregoing in FIG. 8A, the total exitance contrast between the target and the pattern that is seen from an infrared camera can be calculated according to the following equation:

$$\Delta M_{TB}(\lambda,\Delta T_{effective})=(\varepsilon_T-\varepsilon_B)[M_{TE}(\lambda,T_T)-M_{TR}(\lambda,T_B)]K(\varepsilon_T-\varepsilon_B)M_T(\lambda,\Delta T_{eff})$$

Heating the target, coupled with the different emissivities of the target and the pattern, effectively creates camouflage for the target against detection by detectors sensitive to the wavelength λ and the temperatures T of the target. Thus, as shown in FIG. 8A, in accordance with the present invention, active emissivity targets provide an 'effective' temperature contrast due to emissivity differences when the target plate is heated.

FIG. 8B provides an alternative way to understand these principles. As shown in FIG. 8B, background is designated as ambient, and again is the ambient background environment, and has a temperature $T_{ambient}$, and the target has a temperature, $T_{target}$. The ambient energy directly reflected from the target and the pattern is designated $E_{BGND\text{-}reflect}$ and $E_{TGT\text{-}reflect}$, respectively. The energy modified by the emissivity of the target and the pattern is designated $E_{BGND\text{-}emitt}$ and $E_{TGT\text{-}emit}$, respectively.

Based on the foregoing in FIG. 8B, an energy contrast, $\Delta E_{TB}$, is defined, which is the difference between the target and the background, by the following equation:

$$\Delta E_{TB}=E_{TGT}-E_{BGND}=(\varepsilon_T\sigma T_{tgt}^4+R_T\sigma T_{amb}^4)-(\varepsilon_B\sigma T_{tgt}^4+R_B\sigma T_{amb}^4)$$

Both the target and the background have a specular reflectance, R=1−ε. When this is substituted for the reflectance terms $R_T$ and $R_B$ in the above equation, the equation is modified as follows:

$$\Delta E_{TB}=E_{TGT}-E_{BGND}=(\varepsilon_T\sigma T_{tgt}^4+(1-\varepsilon_T)T_{amb}^4)-(\varepsilon_B\sigma T_{tgt}^4+(1-\varepsilon_B)\sigma T_{amb}^4)$$

which reduces to $$\Delta E_{TB}=(\varepsilon_T-\varepsilon_B)\sigma(T_{tgt}^4-T_{amb}^4)\approx(\varepsilon_T-\varepsilon_B)\sigma\Delta T_{tgt}\times T_{amb}^3$$

when $\Delta T_{tgt}=T_{tgt}$ $T_{amb}<<T_{amb}$, and once again, $\Delta E_{TB}\approx\Delta E_{TB}\approx k(\varepsilon_T-\varepsilon_B)\,\Delta T_{tgt}$ for temperatures close to $T_{amb}$. This derivation is intended to provide insight, although the present invention is not considered limited to temperatures close to ambient temperature and can work for high delta T's as well.

In accordance with the present invention, by utilizing the foregoing principles applying the Stefan-Boltzmann radiation law in the infrared camouflage textiles described herein, a very effective camouflage is provided, one which is difficult or impossible to discern within the range of resolution of infrared sensors, infrared cameras and/or FLIR systems.

Figure 9:
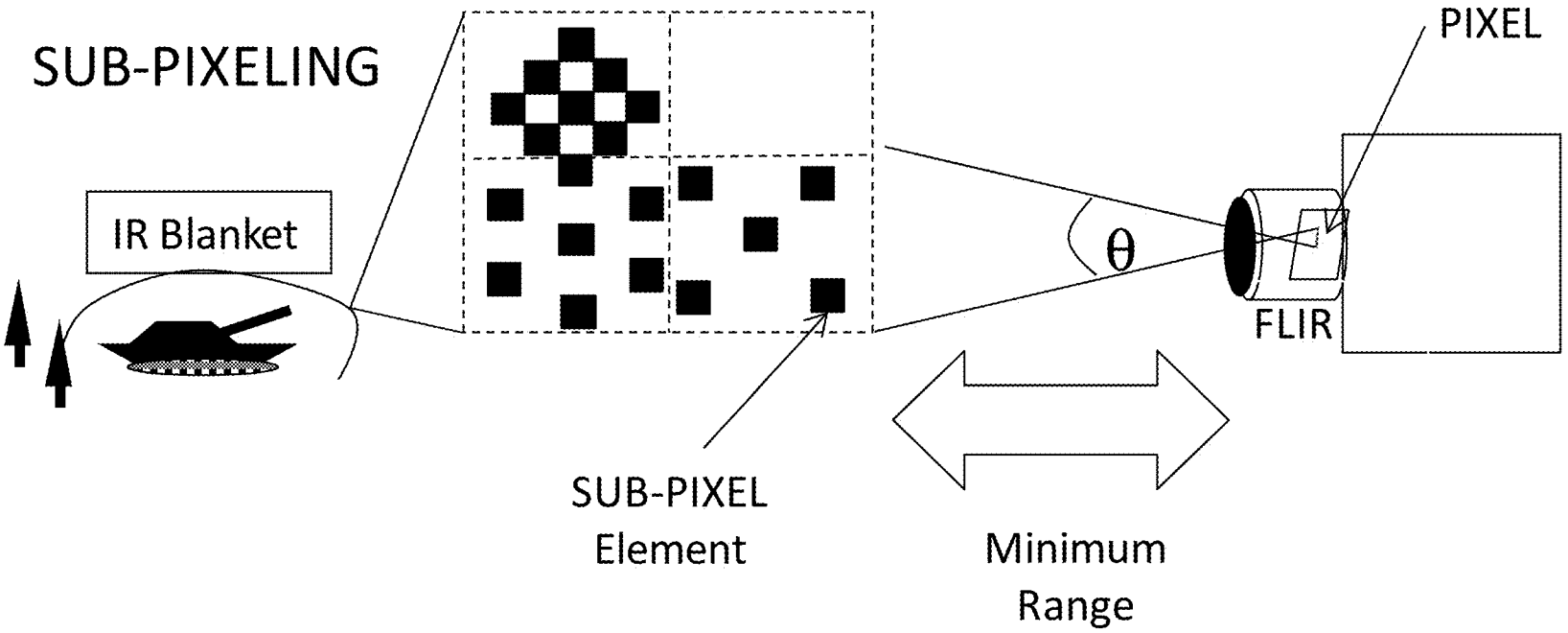
FIG. 9 is a schematic diagram depicting a relationship between the pixel size in the detector of a sensing device such as an FLIR camera or other infrared detection device and the size of a sub-pixel in an infrared camouflage textile in accordance with embodiments of the present invention.

FIG. 9 is a schematic diagram depicting a relationship between the pixel size in the detector of a sensing device such as an FLIR camera or other detection device and the size of a sub-pixel in an infrared camouflage textile in accordance with embodiments of the present invention.

As is well known, a given digital device, such as an infrared detector, an infrared camera, other digital detector or digital camera has a given resolution, generally defined by the size of individual picture elements, i.e., pixels. Each pixel in a detector has a specific, known size. When the pixel is exposed to incoming radiation through, e.g., a lens, the radiation arriving at the pixel is focused on the pixel by the lens, and that radiation represents all the radiation arriving at the lens at the exact location on the lens from which the radiation is focused on the pixel. Thus, all of the light from a given area at a given distance, corresponding to the pixel size inside the detector, is what the pixel "sees". In reality the FLIR pixel together with the focal length of the FLIR optics determines a subtended angle that is the minimum angle that the thermal camera or FLIR can resolve. Utilizing this information coupled with the minimum expected range allows us to determine a minimum "pixel" size for our textile. And therefore any elements smaller than this size are "sub-pixel", cannot be resolved by the remote detection device and can be used to provide emissivity and temperature 'shading' due to area weighting of these sub-pixel elements.

As schematically illustrated in FIG. 9, an infrared camouflage textile in accordance with the present invention (referred to in FIG. 9 as "IR blanket") may cover a target such as a tank. The infrared camouflage textile includes a very large number of pixel elements, each of which contains a plurality of sub-pixel elements. As described in the present description of embodiments of the present invention, the emissivity of the sub-pixels in the infrared camouflage textile can be individually controlled. As described in the following, the sub-pixels are too small to be resolved by known detection devices at distances expected to be utilized by a detection device having a given resolution.

As schematically illustrated in FIG. 9, a detection device such as the FLIR shown in FIG. 9, includes a large number of pixels, one of which is shown. As described above, a certain angular slice, represented by the angle Θ in FIG. 9, of the incoming radiation from a target is focused upon each single pixel. The radiation that falls on that pixel, when extrapolated by the angle Θ over a distance represented by the Minimum Range in FIG. 9, is derived from a much larger "pixel" at the distance of the range. This effect is schematically illustrated in FIG. 9, which shows that, at a given distance and resolution (i.e., detector pixel size), the "pixel" at the distant location is much larger than can be resolved by the detector. As a result, if the distant, large pixel is divided into sub-pixels having a small size relative to the distant, large pixel, the sub-pixel elements can be manipulated selectively in accordance with the present invention to provide larger pixels that have selectively controllable features in terms of effective emissivity in particular, but also of brightness, effective temperature, etc., which cannot be individually resolved by the detector device.

Figure 10:
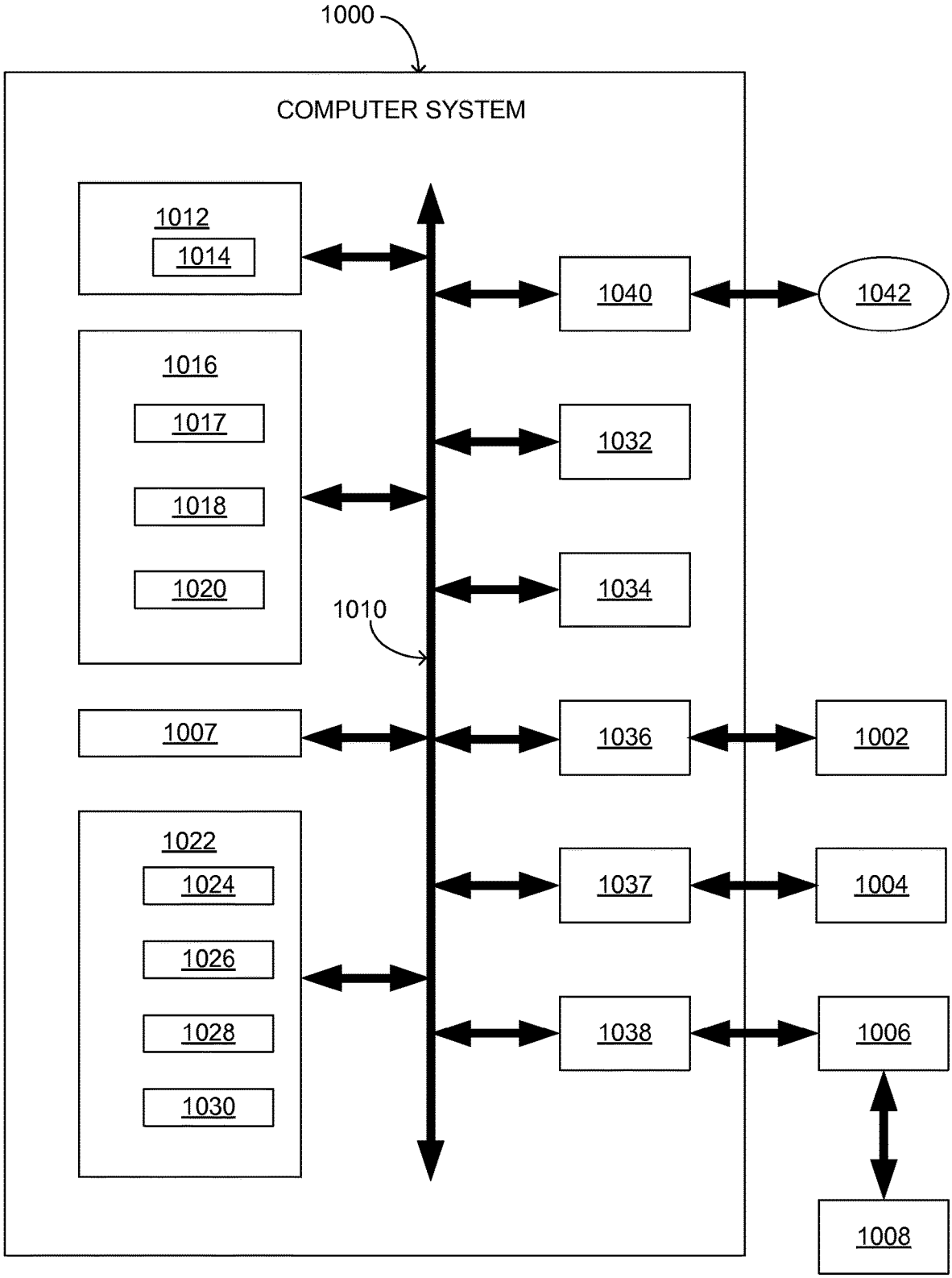
FIG. 10 is a schematic diagram depicting elements of a computer system which may be used in conjunction with and/or to control the operation of an embodiment of the infrared camouflage textile in accordance with the present invention.

FIG. 10 is a schematic diagram depicting elements of a computer system 1000 which may be used in conjunction with and/or to control the operation of an embodiment of the infrared camouflage textile in accordance with the present invention. The computer system 1000 may, in various embodiments, comprise equipment capable of generating electrical signals that may be sent to the infrared camouflage textile in the various embodiments described herein. The computer system 1000 may also include equipment (such as memory elements) to store emissivity patterns or sequences of patterns. In some embodiments, the computer system 1000 may include facilities for developing emissivity patterns or sequences of emissivity patterns. The emissivity patterns or sequences may be sent to the infrared camouflage textile using electrical signals. Various embodiments of components suitable to implement the computer system 1000 are discussed in the following. It will be understood by the skilled person that the following description is intended to be exemplary of such a computer system, and the description is not limiting of the scope of the invention.

FIG. 10 illustrates an exemplary computer system 1000 suitable for implementing one or more portions of particular embodiments of a target system. For example, aspects of the computer system 1000 may be utilized to determine patterns for display, generate electrical signals representing target patterns, and/or storing and retrieving target patterns. Although the present disclosure describes and illustrates a particular computer system 1000 having particular components in a particular configuration, the present disclosure contemplates any suitable computer system having any suitable components in any suitable configuration. Moreover, the computer system 1000 may take any suitable physical form, such as for example one or more integrated circuit (ICs), one or more printed circuit boards (PCBs), one or more handheld or other devices (such as mobile telephones or PDAs), one or more personal computers, or one or more super computers. The programmable pattern CPU 126 and/or the temperature controller 112 discussed above with respect to FIGS. 1-6 may be implemented using all of the components, or any appropriate combination of the components, of the computer system 1000 described herein.

The computer system 1000 may have one or more input devices 1002 (which may include a keypad, keyboard, mouse, stylus, etc.), one or more output devices 1004 (which may include one or more displays, one or more speakers, one or more printers, etc.), one or more storage devices 1006, and one or more storage medium 1008. An input device 1002 may be external or internal to the computer system 1000. An output device 1004 may be external or internal to the computer system 1000. A storage device 1006 may be external or internal to the computer system 1000. A storage medium 1008 may be external or internal to the computer system 1000.

System bus 1010 couples subsystems of the computer system 1000 to each other. Herein, reference to a bus encompasses one or more digital signal lines serving a common function. The present disclosure contemplates any suitable system bus 1010 including any suitable bus structures (such as one or more memory buses, one or more peripheral buses, one or more a local buses, or a combination of the foregoing) having any suitable bus architectures. Example bus architectures include, but are not limited to, Industry Standard Architecture (ISA) bus, Enhanced ISA (EISA) bus, Micro Channel Architecture (MCA) bus, Video Electronics Standards Association local (VLB) bus, Peripheral Component Interconnect (PCI) bus, PCI-Express bus (PCI-X), and Accelerated Graphics Port (AGP) bus.

The computer system 1000 includes one or more processors 1012 (or central processing units (CPUs)). A processor 1012 may contain a cache 1014 for temporary local storage of instructions, data, or computer addresses. Processors 1012 are coupled to one or more storage devices, including memory 1016. Memory 1016 may include random access memory (RAM) 1018 and read-only memory (ROM) 1020. Data and instructions may transfer bi-directionally between processors 1012 and RAM 1018. Data and instructions may transfer uni-directionally to processors 1012 from ROM 1020. RAM 1018 and ROM 1020 may include any suitable computer-readable storage media. The computer system 1000 includes fixed storage 1022 coupled bi-directionally to processors 1012. Fixed storage 1022 may be coupled to processors 1012 via storage control unit 1007. Fixed storage 1022 may provide additional data storage capacity and may include any suitable computer-readable storage media. Fixed storage 1022 may store an operating system (OS) 1024, one or more executables (EXECs) 1026, one or more applications or programs 1028, data 1030 and the like. Fixed storage 1022 is typically a secondary storage medium (such as a hard disk) that is slower than primary storage. In appropriate cases, the information stored by fixed storage 1022 may be incorporated as virtual memory into memory 1016.

Processors 1012 may be coupled to a variety of interfaces, such as, for example, graphics control 1032, video interface 1034, input interface 1036, output interface 1037, and storage interface 1038, which in turn may be respectively coupled to appropriate devices. Example input or output devices include, but are not limited to, video displays, track balls, mice, keyboards, microphones, touch-sensitive displays, transducer card readers, magnetic or paper tape readers, tablets, styli, voice or handwriting recognizers, biometrics readers, or computer systems.

Network interface 1040 may couple processors 1012 to another computer system or to network 1042. Network interface 1040 may include wired, wireless, or any combination of wired and wireless components. Such components may include wired network cards, wireless network cards, radios, antennas, cables, or any other appropriate components. With network interface 1040, processors 1012 may receive or send information from or to network 1042 in the course of performing steps of particular embodiments. Particular embodiments may execute solely on processors 1012. Particular embodiments may execute on processors 1012 and on one or more remote processors operating together.

In a network environment, where the computer system 1000 is connected to network 1042, the computer system 1000 may communicate with other devices connected to network 1042. The computer system 1000 may communicate with network 1042 via network interface 1040. For example, the computer system 1000 may receive information (such as a request or a response from another device) from network 1042 in the form of one or more incoming packets at network interface 1040 and memory 1016 may store the incoming packets for subsequent processing. The computer system 1000 may send information (such as a request or a response to another device) to network 1042 in the form of one or more outgoing packets from network interface 1040, which memory 1016 may store prior to being sent. Processors 1012 may access an incoming or outgoing packet in memory 1016 to process it, according to particular needs. In various embodiments, such activity may be used to implement aspects of programmable pattern CPU 126, temperature controller 112, ambient sensor 120, and/or other computing device such as illustrated in FIGS. 1-6.

Particular embodiments involve one or more computer-storage products that include one or more tangible, computer-readable storage media that embody software for performing one or more steps of one or more processes described or illustrated or both may be designed and manufactured specifically to perform one or more steps of one or more processes described or illustrated herein. In addition or as an alternative, in particular embodiments, one or more portions of the media, the software, or both may be generally available without design or manufacture specific to processes described or illustrated herein. Example computer-readable storage media include, but are not limited to, CDs (such as CD-ROMs), FPGAs, floppy disks, optical disks, hard disks, holographic storage devices, ICs (such as ASICs), magnetic tape, caches, PLDs, RAM devices, ROM devices, semiconductor memory devices, and other suitable computer-readable storage media. In particular embodiments, software may be machine code which a compiler may generate or one or more files containing higher-level code which a computer may execute using an interpreter. As an example and not by way of limitation, memory 1016 may include one or more computer-readable storage media embodying software (e.g., code) and computer system 1000 may provide particular functionality described or illustrated herein as a result of processors 1012 executing the software (e.g., code). Such a configuration may, in various embodiments, be suitable for implementing aspects of programmable pattern CPU 126, temperature controller 112, ambient sensor 120, and/or other computing device such as illustrated in FIGS. 1-6. Memory 1016 may store (e.g., in RAM 1018 and/or ROM 1020) and processors 1012 may execute the software. Memory 1016 may read the software from the computer-readable storage media in mass storage device 1016 embodying the software or from one or more other sources via network interface 1040.

When executing the software (such as target program 1017), processors 1012 may perform one or more steps of one or more processes described or illustrated herein (for example, operations of programmable pattern CPU 126, temperature controller 112, ambient sensor 120, and/or other computing device such as illustrated in FIGS. 1-6), which may include defining one or more data structures for storage in memory 1016 and modifying one or more of the data structures as directed by one or more portions the software, according to particular needs. For example, patterns representing targets may be stored, retrieved, and designed utilizing processors 1012 and memory 1016.

In some embodiments, the described processing and memory elements (such as processors 1012 and memory 1016) may be distributed across multiple devices such that the operations performed utilizing these elements may also be distributed across multiple devices. For example, software operated utilizing these elements may be run across multiple computers that contain these processing and memory elements. Other variations aside from the stated example are contemplated involving the use of distributed computing. In addition or as an alternative, the computer system 1000 may provide particular functionality described or illustrated herein as a result of logic hardwired or otherwise embodied in a circuit, which may operate in place of or together with software to perform one or more steps of one or more processes described or illustrated herein. The present disclosure encompasses any suitable combination of hardware and software, according to particular needs.

It is noted that, throughout the specification and claims, the numerical limits of the disclosed ranges and ratios may be combined, and are deemed to include all intervening values. Furthermore, all numerical values are deemed to be preceded by the modifier "about", whether or not this term is specifically stated.

While the principles of the invention have been explained in relation to certain particular embodiments, and are provided for purposes of illustration. It is to be understood that various modifications thereof will become apparent to those skilled in the art upon reading the specification. Therefore, it is to be understood that the invention disclosed herein is intended to cover such modifications as fall within the scope of the appended claims. The scope of the invention is limited only by the scope of the claims.

The invention claimed is:

1. An infrared camouflage textile, comprising:

an emissivity layer disposed on an outer surface of the textile and comprised of a predetermined pattern of at least two different infrared emissivities, the emissivity layer adapted to create multiple effective temperatures on a large scale while maintaining a constant temperature across the predetermined pattern;

a heating layer disposed below the emissivity layer, the heating layer adapted to provide the constant temperature across the predetermined pattern; and a power source operably linked to the heating layer.

2. The infrared camouflage textile of claim 1 further comprising an insulating layer disposed on a first side of the textile and adapted to absorb a native infrared signature of a body adjacent the first side.

3. The infrared camouflage textile of claim 1 further comprising a thermal conductive or thermal foil layer disposed between the heating layer and the emissivity layer.

4. The infrared camouflage textile of claim 1 wherein the at least two different infrared emissivities create an infrared signature distinct from the native infrared signature.

5. The infrared camouflage textile of claim 1 wherein the at least two different infrared emissivities are disposed on a same layer.

6. The infrared camouflage textile of claim 1 wherein the predetermined pattern is composed of pixels or subpixels.

7. The infrared camouflage textile of claim 6 wherein size of the pixels or subpixels is based on predetermined estimated resolution of and predetermined estimated distance from a FLIR device or a thermal imaging device against which the textile is to provide camouflage.

8. The infrared camouflage textile of claim 1 further comprising a spacer or stand-off layer between the heating layer and the insulating layer.

9. The infrared camouflage textile of claim 1 wherein the emissivity layer comprises at least two materials having different infrared emissivities.

10. An infrared camouflage textile, comprising:

an emissivity layer disposed on a second side of the textile and comprised of a selectably pixelated pattern of at least two different infrared emissivities on an outer surface of the textile, the selectably pixelated pattern comprising a plurality of pixels, each pixel comprising a plurality of subpixel elements, the emissivity layer adapted to create multiple effective temperatures in the subpixel elements to create multiple effective temperatures on a scale of the pixels across the selectably pixelated pattern while maintain a constant temperature across the selectably pixelated pattern;

a heating layer disposed below the emissivity layer and above the insulating layer, the heating layer adapted to provide the constant temperature across the selectably pixelated pattern; and a power source operably linked to the heating layer, wherein the emissivity layer comprises:

a display module comprising a plurality of the subpixel elements operable to display the selectably pixelated pattern in the emissivity layer, wherein each subpixel element comprises:

a display segment;

a plurality of first charged pigments housed within the display segment each having a first charge and a first emissivity;

a plurality of second charged pigments housed within the display segment each having a second charge and a second emissivity, wherein the first charge is opposite the second charge and the first emissivity is different from the second emissivity;

an electrical contact coupled to the display segment and operable to receive signals that cause an electric field to be present in the display segment;

at least one computer-readable tangible storage medium comprising executable code that, when executed by at least one processor, is operable to transmit signals to the display module that cause an electric field to be present in at least one subpixel element of the plurality of subpixel elements to form the selectably pixelated pattern in the emissivity layer.

11. The infrared camouflage textile of claim 10 further comprising an insulating layer disposed on a first side of a textile and adapted to absorb a native infrared signature of a body adjacent the first side.

12. The infrared camouflage textile of claim 10 further comprising a thermal conductive or thermal foil layer disposed between the heating layer and the emissivity layer.

13. The infrared camouflage textile of claim 10 wherein the at least two different infrared emissivities create an infrared signature distinct from the native infrared signature.

14. The infrared camouflage textile of claim 10 wherein size of the subpixel elements is based on a predetermined estimated resolution of and a predetermined estimated distance from an infrared camera or non-imaging thermal sensing device against which the textile is to provide camouflage.

15. The infrared camouflage textile of claim 10 further comprising a spacer or stand-off layer.

16. The infrared camouflage textile of claim 10 wherein the emissivity layer comprises at least two materials having different infrared emissivities.

17. The infrared camouflage textile of claim 10 wherein the selectably pixelated pattern is based on output of an infrared camera or non-imaging thermal sensing device.

18. The infrared camouflage textile of claim 10 further comprising a plurality of outwardly facing surfaces each displaying a portion of the selectably pixelated pattern, and the selectably pixelated pattern of each outwardly facing surface is selected based on output of an infrared camera or non-imaging thermal sensing device associated with that outwardly facing surface.

* * * * *